US007722762B2

(12) United States Patent
Zubair

(10) Patent No.: US 7,722,762 B2
(45) Date of Patent: May 25, 2010

(54) HORIZONTALLY TRAVELING WATER SCREEN

(75) Inventor: Omair Zubair, Kenner, LA (US)

(73) Assignee: Laitram, L.L.C., Harahan, LA (US)

( * ) Notice: Subject to any disclaimer, the term of this patent is extended or adjusted under 35 U.S.C. 154(b) by 1316 days.

(21) Appl. No.: 11/161,095

(22) Filed: Jul. 22, 2005

(65) Prior Publication Data

US 2007/0017858 A1 Jan. 25, 2007

(51) Int. Cl.
*E03F 5/14* (2006.01)

(52) U.S. Cl. ..... 210/160; 210/400; 210/783

(58) Field of Classification Search ..... None
See application file for complete search history.

(56) References Cited

U.S. PATENT DOCUMENTS 1,346,881 A * 7/1920 Dixon ..... 210/156
1,420,508 A * 6/1922 Walker ..... 210/157
1,426,217 A * 8/1922 Roddy ..... 210/160
1,451,394 A * 4/1923 Hurst ..... 210/162
1,486,034 A * 3/1924 Rhudy ..... 210/157
1,493,405 A * 5/1924 Tuckfield ..... 210/156
1,559,535 A * 10/1925 Roddy et al. ..... 210/160
1,658,875 A * 2/1928 Arnold ..... 210/156
1,692,451 A * 11/1928 Kinney ..... 210/156
1,732,649 A * 10/1929 Hobart ..... 210/160
1,799,457 A * 4/1931 Cuttle et al. ..... 210/162
1,815,137 A * 7/1931 Bleyer ..... 210/160
1,856,381 A * 5/1932 Gary ..... 210/160
1,874,736 A * 8/1932 Bleyer ..... 210/160
1,875,790 A * 9/1932 Willis ..... 210/156
1,913,303 A * 6/1933 Bleyer ..... 210/160
1,925,251 A * 9/1933 Hobart ..... 210/160
1,942,381 A * 1/1934 Benesh ..... 210/783
1,947,752 A * 2/1934 Benesh ..... 239/523
1,963,460 A * 6/1934 Bleyer ..... 210/160
2,056,445 A * 10/1936 Damman ..... 210/157
2,074,407 A * 3/1937 Lowe ..... 210/157
2,095,504 A * 10/1937 Kesti et al. ..... 210/160
2,162,325 A * 6/1939 Briles ..... 210/156
2,198,943 A * 4/1940 Lowe ..... 210/162
2,286,332 A * 6/1942 Bleyer ..... 210/160

(Continued)

FOREIGN PATENT DOCUMENTS

EP 1746212 A2 * 1/2007

(Continued)

OTHER PUBLICATIONS

Intralox, "Product Line Extension Series 1800 Mesh Top Belt," 2001, Intralox, Inc., Harahan, LA.

(Continued)

*Primary Examiner*—Robert James Popovics
(74) *Attorney, Agent, or Firm*—James T. Cronrich

(57) ABSTRACT

A horizontally traveling water screen for filtering debris from a wide flowing stream. The water screen, which may be realized by a foraminous modular plastic conveyor belt, is formed in an endless loop trained between drive and idle sprockets rotatable on generally vertical shafts. The upstream face of the water screen is oriented transverse to the flow and advances horizontally across the stream to drag debris to a cleaning and discharge station. Horizontally spaced hold down tabs extending outward of the inner surface of the loop hook onto and ride along a horizontal guide attached to a support frame for the water screen to prevent the screen from sagging.

16 Claims, 7 Drawing Sheets

U.S. PATENT DOCUMENTS

| | | | | | |
|---|---|---|---|---|---|
| 2,309,472 | A | * | 1/1943 | Morton | 210/156 |
| 2,428,757 | A | * | 10/1947 | Lind | 198/834 |
| 2,851,162 | A | * | 9/1958 | Bleyer | 210/158 |
| 2,899,062 | A | * | 8/1959 | Heacock | 210/97 |
| 2,975,646 | A | * | 3/1961 | Buchanan, Jr. | 474/136 |
| 3,093,578 | A | * | 6/1963 | Hofmeister | 210/91 |
| 3,508,659 | A | * | 4/1970 | Bates et al. | 210/160 |
| 3,789,587 | A | * | 2/1974 | Moorefield, II | 406/78 |
| 3,802,565 | A | | 4/1974 | Hughes et al. | 210/160 |
| 3,868,324 | A | * | 2/1975 | Taylor et al. | 210/158 |
| 4,013,561 | A | | 3/1977 | Murphy | |
| 4,064,048 | A | * | 12/1977 | Downs et al. | 210/160 |
| 4,169,792 | A | * | 10/1979 | Dovel | 210/793 |
| 4,176,984 | A | * | 12/1979 | Sommers | 405/81 |
| 4,186,091 | A | * | 1/1980 | Sutton | 210/783 |
| 4,199,453 | A | * | 4/1980 | McCawley et al. | 210/160 |
| 4,343,698 | A | | 8/1982 | Jackson | 210/107 |
| 4,360,426 | A | | 11/1982 | Wetzel | 210/160 |
| 4,415,462 | A | * | 11/1983 | Finch et al. | 210/767 |
| 4,443,126 | A | | 4/1984 | Strow et al. | 403/24 |
| 4,447,323 | A | * | 5/1984 | Jackson | 210/158 |
| 4,447,324 | A | | 5/1984 | Jackson | 210/159 |
| 4,518,494 | A | | 5/1985 | Jackson | 210/158 |
| 4,541,930 | A | | 9/1985 | Heidler et al. | 210/344 |
| 4,582,601 | A | | 4/1986 | Strow et al. | 210/161 |
| 4,676,893 | A | * | 6/1987 | Travade et al. | 210/157 |
| 4,806,242 | A | | 2/1989 | Jackson | 210/303 |
| 4,812,231 | A | | 3/1989 | Wiesemann | 210/158 |
| 4,892,652 | A | | 1/1990 | Rudy et al. | 210/160 |
| 4,919,346 | A | | 4/1990 | Chambers, Sr. | |
| 4,929,122 | A | | 5/1990 | Yoas | 405/81 |
| 4,935,131 | A | * | 6/1990 | Pindar | 210/160 |
| 5,060,872 | A | * | 10/1991 | Chambers, Sr. | 241/46.02 |
| 5,061,380 | A | * | 10/1991 | Stevenson | 210/768 |
| 5,094,751 | A | * | 3/1992 | Ramsey et al. | 210/409 |
| 5,116,490 | A | * | 5/1992 | Fontenot | 210/158 |
| 5,222,920 | A | * | 6/1993 | Cheesman et al. | 474/213 |
| 5,242,583 | A | | 9/1993 | Thomas | 210/161 |
| 5,320,286 | A | * | 6/1994 | Chambers et al. | 241/46.02 |
| 5,326,460 | A | | 7/1994 | Cheesman et al. | 210/160 |
| 5,333,801 | A | | 8/1994 | Chambers, Sr. et al. | |
| 5,387,336 | A | | 2/1995 | Bormet et al. | 210/158 |
| 5,415,766 | A | * | 5/1995 | Quick et al. | 210/160 |
| 5,419,832 | A | * | 5/1995 | Heinen et al. | 210/160 |
| 5,489,378 | A | * | 2/1996 | Cheesman et al. | 210/90 |
| 5,501,793 | A | | 3/1996 | Cheesman et al. | 210/160 |
| 5,653,874 | A | * | 8/1997 | Berry, III | 210/159 |
| 5,788,839 | A | * | 8/1998 | Gargan et al. | 210/160 |
| 5,919,358 | A | | 7/1999 | Williams | 210/160 |
| 6,187,184 | B1 | | 2/2001 | Reetz et al. | 210/155 |
| 6,382,405 | B1 | | 5/2002 | Palmaer | |
| 6,524,028 | B2 | | 2/2003 | Bryan | 405/81 |
| 6,613,238 | B2 | * | 9/2003 | Schloss | 210/791 |
| 6,698,595 | B2 | | 3/2004 | Norell et al. | 201/499 |
| 7,048,850 | B2 | * | 5/2006 | DePaso et al. | 210/155 |
| 7,258,790 | B2 | * | 8/2007 | Brune et al. | 210/602 |
| 7,300,572 | B2 | * | 11/2007 | DePaso et al. | 210/158 |
| 7,393,451 | B2 | * | 7/2008 | Wunsch et al. | 210/160 |
| 2002/0190010 | A1 | * | 12/2002 | Schloss | 210/791 |
| 2005/0115893 | A1 | * | 6/2005 | Brune et al. | 210/602 |
| 2006/0032798 | A1 | * | 2/2006 | DePaso et al. | 210/160 |
| 2006/0037897 | A1 | * | 2/2006 | Jackson | 210/158 |
| 2006/0185967 | A1 | * | 8/2006 | Sedlacek et al. | 198/853 |
| 2006/0201859 | A1 | * | 9/2006 | DePaso et al. | 210/155 |
| 2007/0017858 | A1 | * | 1/2007 | Zubair | 210/160 |
| 2007/0215532 | A1 | * | 9/2007 | Wunsch et al. | 210/160 |
| 2008/0116151 | A1 | * | 5/2008 | Suthard et al. | 210/791 |

FOREIGN PATENT DOCUMENTS

JP 04312610 A * 11/1992

OTHER PUBLICATIONS

Intralox, "Announcing the innovative new fish screen solution that . . . ," Dec. 2003, Intralox, Inc., Harahan, LA.

Nordlund, Bryan and Bates, Ken, "Fish Protection Screen Guidelines for Washington State (Draft)," Apr. 25, 2000, pp. 4-27 and 46-53, Washington Department of Fish and Wildlife.

* cited by examiner

HORIZONTALLY TRAVELING WATER SCREEN

BACKGROUND

The invention relates generally to traveling water screens and, more particularly, to water screens that travel in a generally horizontal direction across a flowing stream of water.

Water is diverted from rivers, lakes, and other bodies of water for municipal, irrigation, and industrial purposes. Fish or water screens serve as filters to prevent fish or debris from entering a water diversion. These screens range in size from a few square feet to several thousand and come in many shapes.

Rotary drum screens consist of a screen mesh wrapped around a cylinder rotating on a generally horizontal axis. The top of the cylindrical screen is above the surface of the water. Debris is carried over the screen as it rotates and is washed off on the downstream side. Because of their fixed diameters, rotary drum screens are restricted in how deep they can be submerged and do not accommodate varying water levels. If the water level is too high, fish and debris are carried over the top of the rotary drum. If the water level drops too low, the screen clogs and water flow is restricted.

Fixed plate screens are also widely used. These stationary plate screens consist of fixed perforated metal sheets or wedge wire panels, usually oriented vertically in a flowing stream of water. Although the fixed plate screens are themselves simple, they require an external cleaning system to prevent clogging. External cleaning systems for plate screens are high maintenance and often not effective. And, if the cleaning system fails, the clogged screen can collapse. External brush cleaners, which are often used, can injure or kill fish.

Another kind of frequently used screen is a vertical traveling screen, which consists of a vertically advancing mesh driven by rotating shaft-mounted sprockets. The axes of the shafts are oriented generally horizontally. The screen may be inclined in the direction of water flow to aid in debris removal. To screen wide diversions, several side-by-side vertical traveling screens have to be used because individual wide vertical traveling screens are expensive to build, support, and drive.

Thus, there is a need for a water screen that is easy to clean and useful in filtering debris from wide diversions.

SUMMARY

This need and other needs are satisfied by a traveling water screen embodying features of the invention. In one version, a traveling water screen comprises a foraminous belt arranged in an endless loop. The belt is disposed in a flowing stream of water generally broadside to the flow. The foraminous belt advances across the stream of water in a generally horizontal direction.

According to another aspect of the invention, a traveling water screen comprises a screen arranged in an endless loop having an outer surface and an inner surface. Openings extend through the thickness of the screen between the outer surface and the inner surface. Means are provided for advancing the screen generally horizontally across a flowing stream of water with the outer surface of the endless loop oriented transverse to the flow.

According to yet another aspect of the invention, a traveling water screen comprises a screen that extends in width from a first side edge to a second side edge. The screen is arranged in an endless loop. Means are provided for advancing the screen through a stream of water. The first side edge of the screen is at a first depth in the stream and the second side edge is elevated above the stream or is at a second depth less than the first depth.

Another version of a traveling water screen comprises a drive wheel below the surface of a body of water with a motor coupled to the drive wheel to rotate the drive wheel about a generally vertical axis of rotation. The traveling water screen also comprises an idle wheel arranged to rotate below the surface of the body of water about a generally vertical axis parallel to the axis of rotation of the drive wheel. A screen in the form of an endless loop is trained about the drive wheel and the idle wheel for advancement in a generally horizontal direction.

According to another aspect of the invention, a traveling water screen comprises a frame, a drive shaft supported in the frame for axial rotation on a generally vertical first axis, and an idle shaft supported in the frame for axial rotation on a generally vertical second axis. A drive sprocket is mounted on the drive shaft for rotation on the first axis, and an idle sprocket is mounted on the idle shaft for rotation on the second axis. A modular belt, trained around and engaging the drive and idle sprockets, has openings through its thickness. The belt is disposed at least partly submerged in a stream of water. A motor coupled to the drive shaft rotates the shaft and the drive sprocket to advance the modular belt through the stream of water.

BRIEF DESCRIPTION OF THE DRAWINGS

These features and aspects of the invention, as well as its advantages, are better understood by reference to the following description, appended claims, and accompanying drawings, in which:

DETAILED DESCRIPTION

Figure 1:
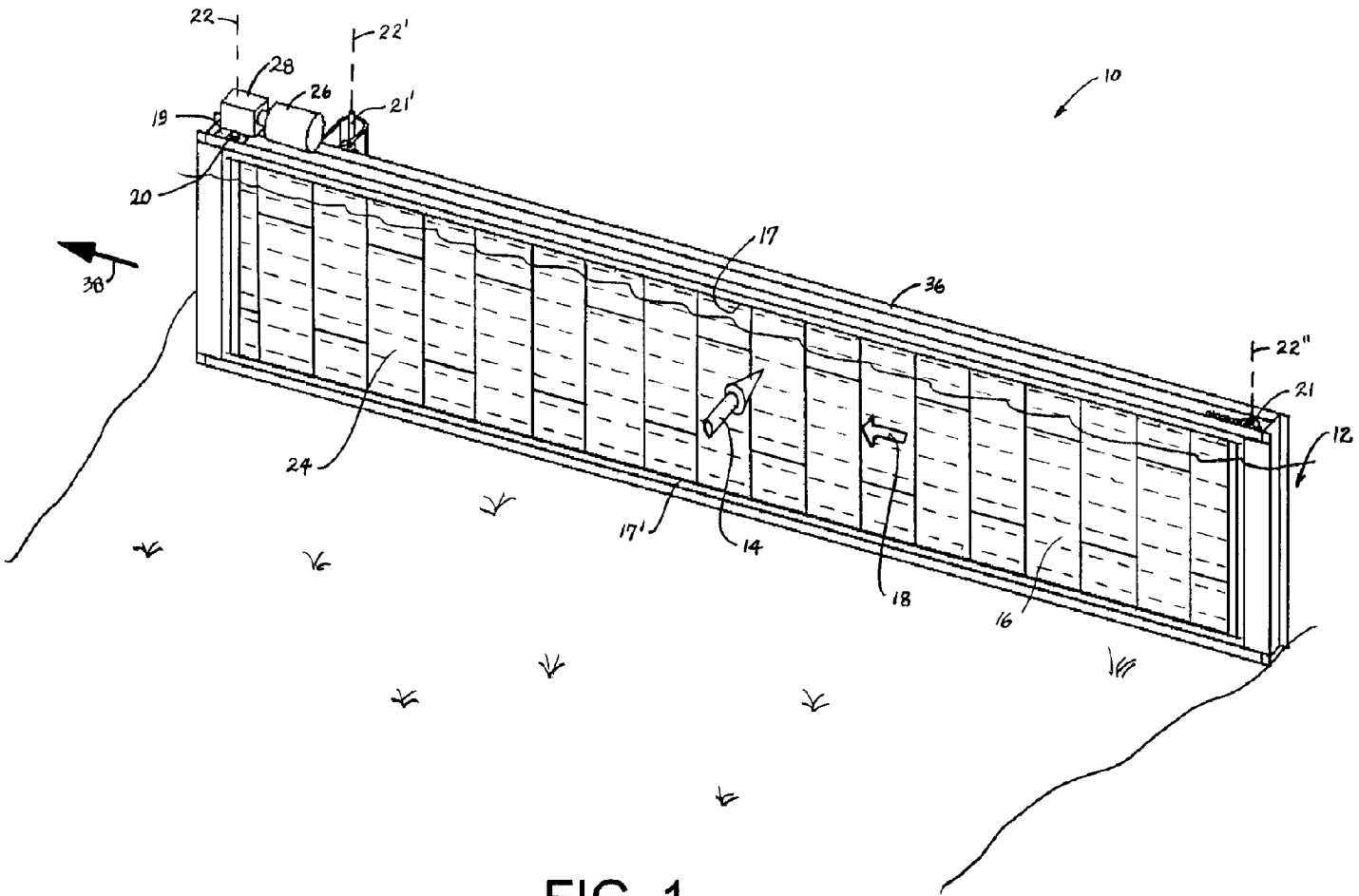
FIG. 1 is an isometric view of a horizontally traveling water screen embodying features of the invention.
Figure 2:
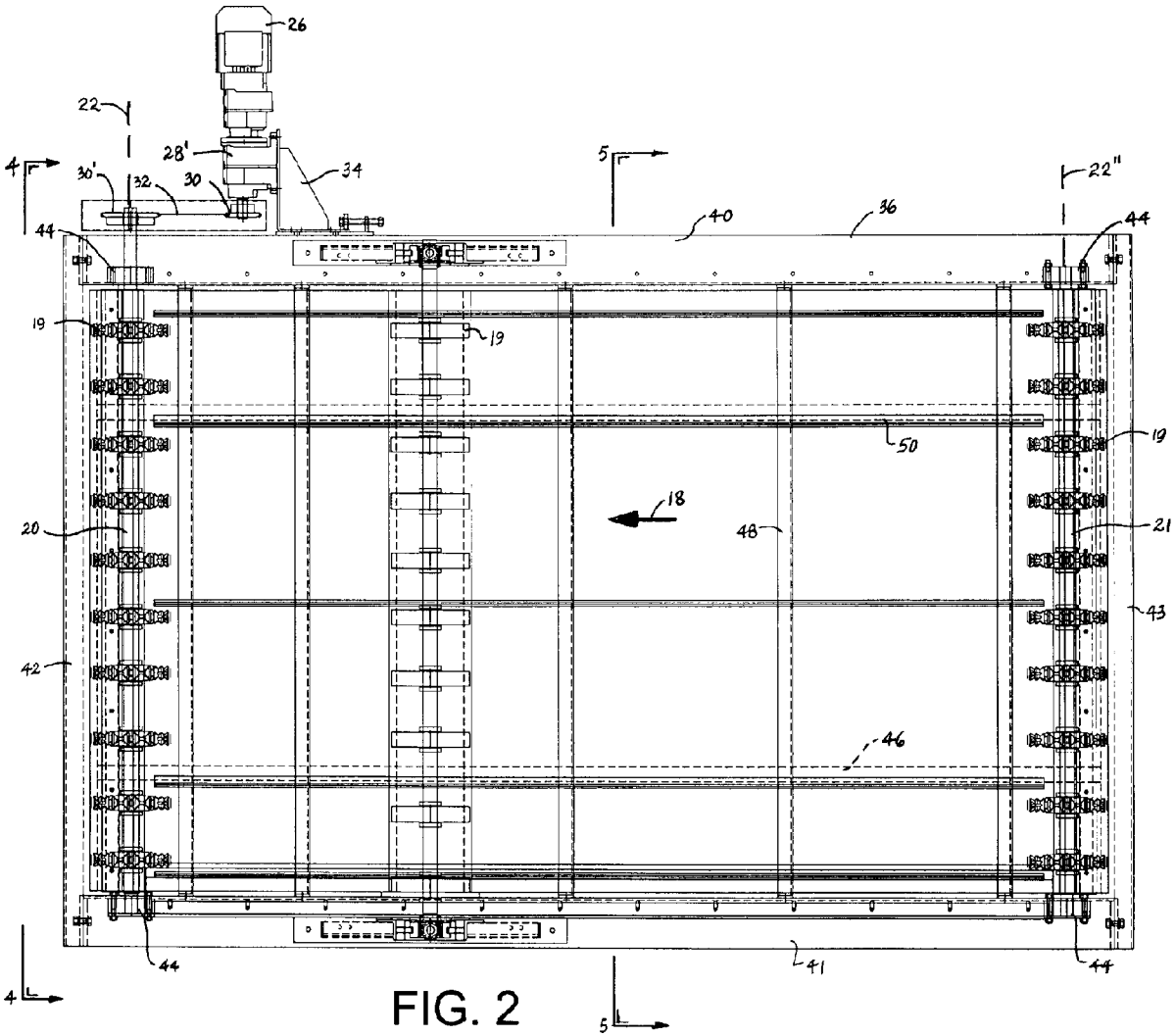
FIG. 2 is a front elevation view of a water screen as in FIG. 1, but with a slightly different drive train.

A horizontally traveling water screen embodying features of the invention is shown in FIGS. 1-7. In FIG. 1 the water screen system 10 is shown largely submerged in a body of water 12. A stream of water flows in a flow direction 14 through a water screen 16 traveling, like a window curtain, in a generally horizontal direction 18. The traveling water screen is arranged in an endless loop trained about wheels, such as sprockets 19 or rollers 19', mounted on a drive shaft 20 and one or more idle shafts 21, 21'. The axes 22, 22', 22" of the shafts are generally vertical, with an outer surface 24 of the loop vertical as well. But the entire screen assembly could be tilted, still transverse to the flow 14, with the axes and the outer surface slanted off vertical. In either case, the screen is generally broadside to the flow with an upper edge 17 of the screen above the surface of the water or submerged at a shallower depth than an opposite lower edge 17'. The screen 16 is driven by a drive motor 26 coupled to the drive shaft. In this example, the motor is coupled to the drive shaft via a right-angle gearbox 28 as in FIG. 1 or via a gearbox 28', chain sprockets 30, 30', and a roller chain 32 as in FIG. 2. The entire drive train is attached by a bracket 34 to a frame 36, which supports the entire screen. The foraminous screen serves as a filter to trap leaves, trash, and other debris that could interfere with or damage downstream equipment. Debris trapped on the upstream outer surface 24 of the screen is dragged to the side of the screen where it is separated from the main diverted flow and discharged as indicated by arrow 38. Scrubbing equipment, such as brushes, scrapers, air-burst systems, or water sprays, can be used at the end of the upstream path of the conveyor to remove the debris for discharge.

Further details of the horizontal traveling screen system are shown in FIGS. 2-7. The traveling screen is supported in the frame 36, which includes upper and lower horizontal sections 40, 41 connected by left and right vertical end pieces 42, 43. The lower section sits directly on the bottom of the body of water or atop a concrete base. Sets of the drive and idle sprockets 19 are mounted to the drive shaft 20 and the idle shaft 21 and retained at vertically spaced positions. Bearing blocks 44 affixed to the frame support the shafts 20, 21 for rotation about their axes 22, 22". Horizontal rails 46 are attached to vertical cross members 48 that are attached at their ends to the upper and lower frame sections. The vertical cross members are arranged two abreast—one row to support rails on the upstream side of the screen and the other row to support rails on the downstream side of the screen. The upstream rails are affixed to the upstream side of their cross members, and the downstream rails are affixed to the downstream side of their cross members. Guides 50 are mounted on flanges 52 extending outward of the rails. The guides, made, for example, of UHMW plastic material, are shown L-shaped with a lip extending upward. The guides could alternatively be made of stainless steel or could be U-shaped. The traveling screen 16 has vertical rows of horizontally spaced hold down tabs 54 along an interior side 25 of the screen loop. The hold down tabs have downwardly extending lips that hook onto the upwardly extending lips of the rail guides 52. As the screen advances in the traveling direction 18, the hold down tabs ride along the guides. By hooking onto the guides, the hold down tabs prevent the screen from sagging under its weight between the shafts.

Figure 3:
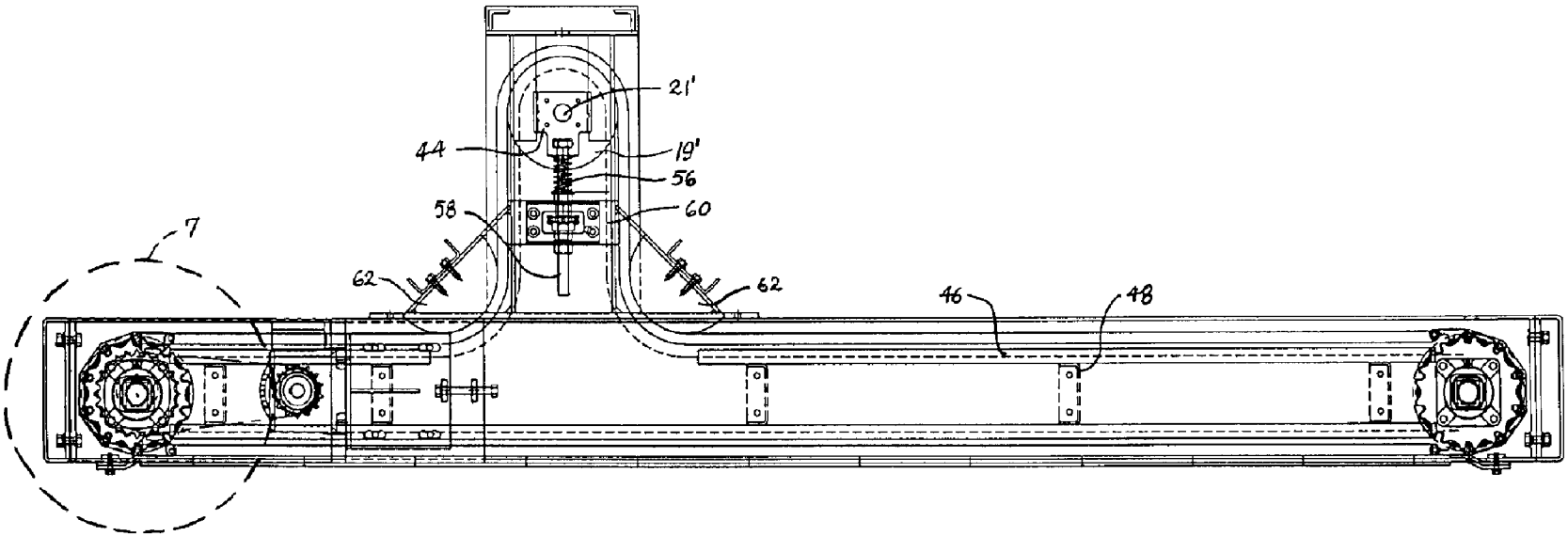
FIG. 3 is a top plan view of the water screen of FIG. 2 with the belt screen eliminated from the drawing for clarity.
Figure 4:
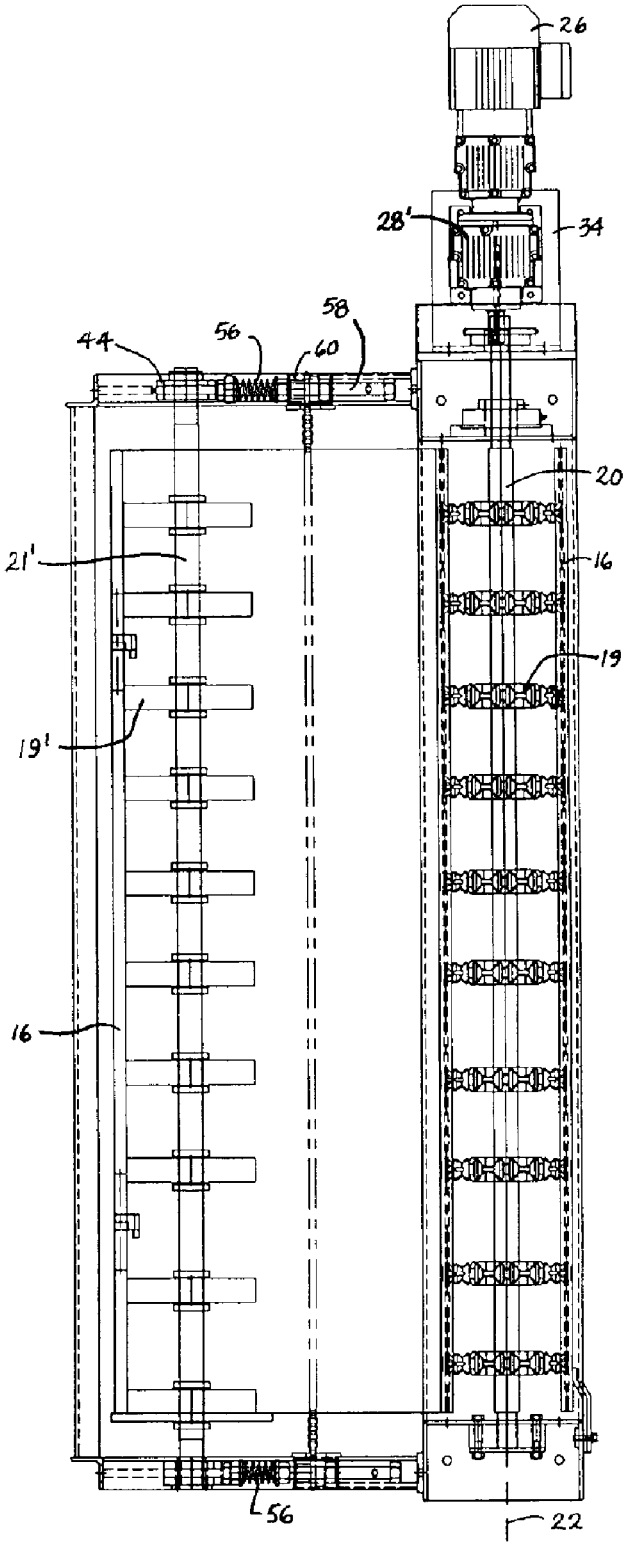
FIG. 4 is a side elevation view of the water screen of FIG. 2 viewed along lines 4-4 of FIG. 3.
Figure 5:
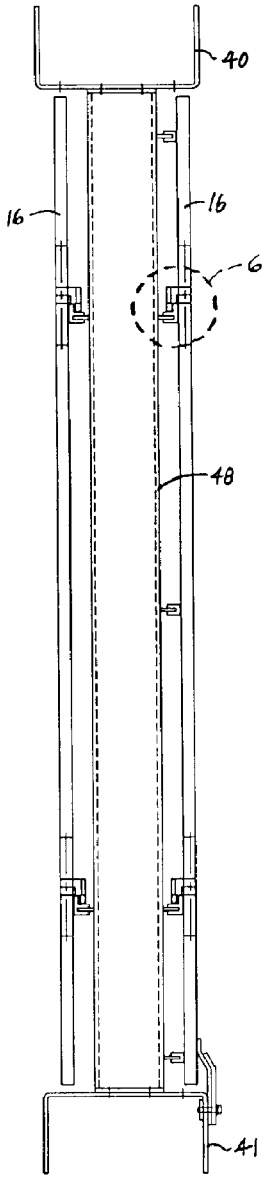
FIG. 5 is a cross section view of the water screen of FIG. 2 taken along lines 5-5 of FIG. 3.
Figure 6:
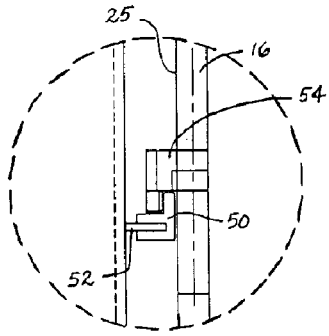
FIG. 6 is an enlarged elevation view of the belt hold down tab retention of the water screen of FIG. 3.
Figure 7:
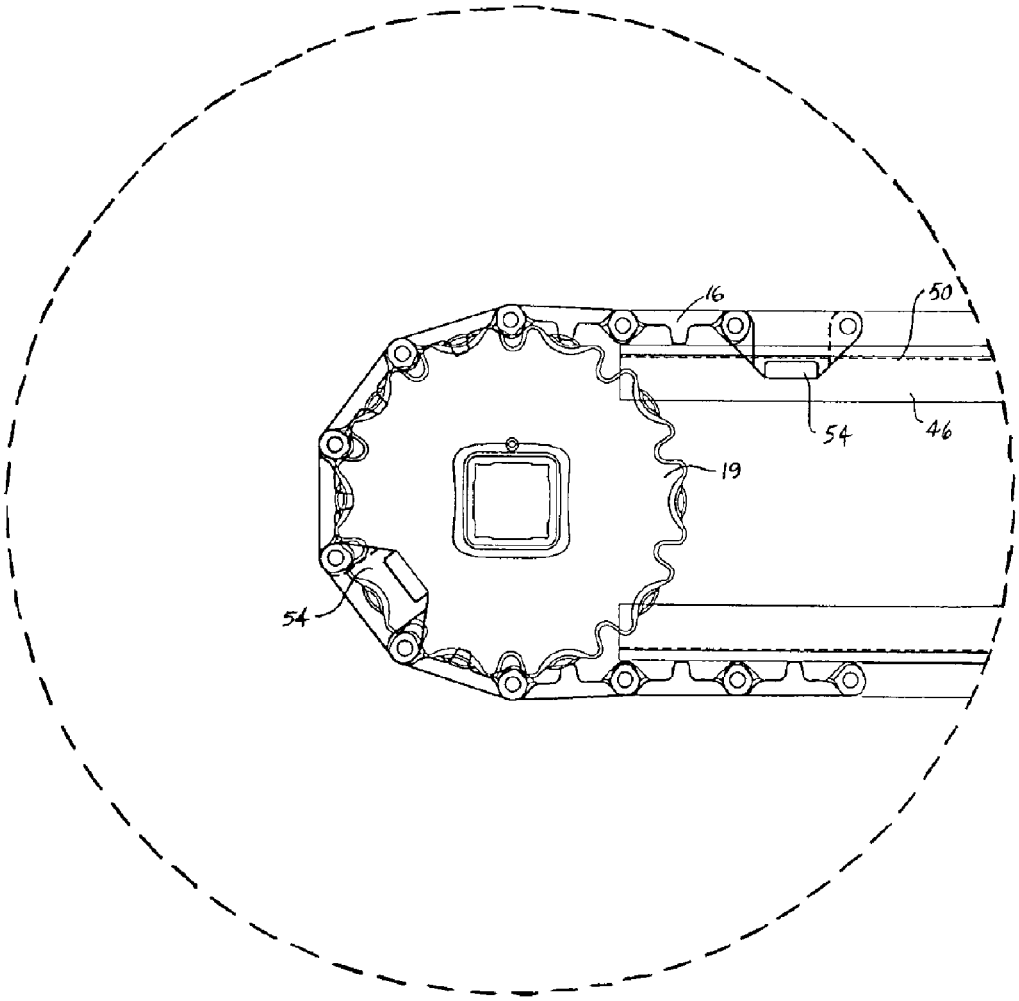
FIG. 7 is an enlarged plan view of the drive sprocket portion of the water screen of FIG. 2.

As shown in FIG. 3, the screen includes a second idle shaft 21' that is on the downstream side of the screen. Instead of toothed sprockets, toothless rollers 19' are mounted at fixed positions on the idle shaft, which is biased at each end by springs 56 pushing in the downstream direction against the shaft's bearing blocks 44 to take up slack in the loop. The bearing blocks are slidably attached to the frame. The coil springs each surround a slidable rod 58 that is attached at one end to the bearing block and extends through a hole in a stationary bracket 60 affixed to the frame. The spring surrounding the rod is compressed between the bracket and the bearing block to apply continuous downstream pressure against the bearing blocks and the shaft to take up slack in the screen. Rollers or semicircular shoes 62 at the entry into and exit from the take-up mechanism hold the screen against the downstream guides.

Figure 8:
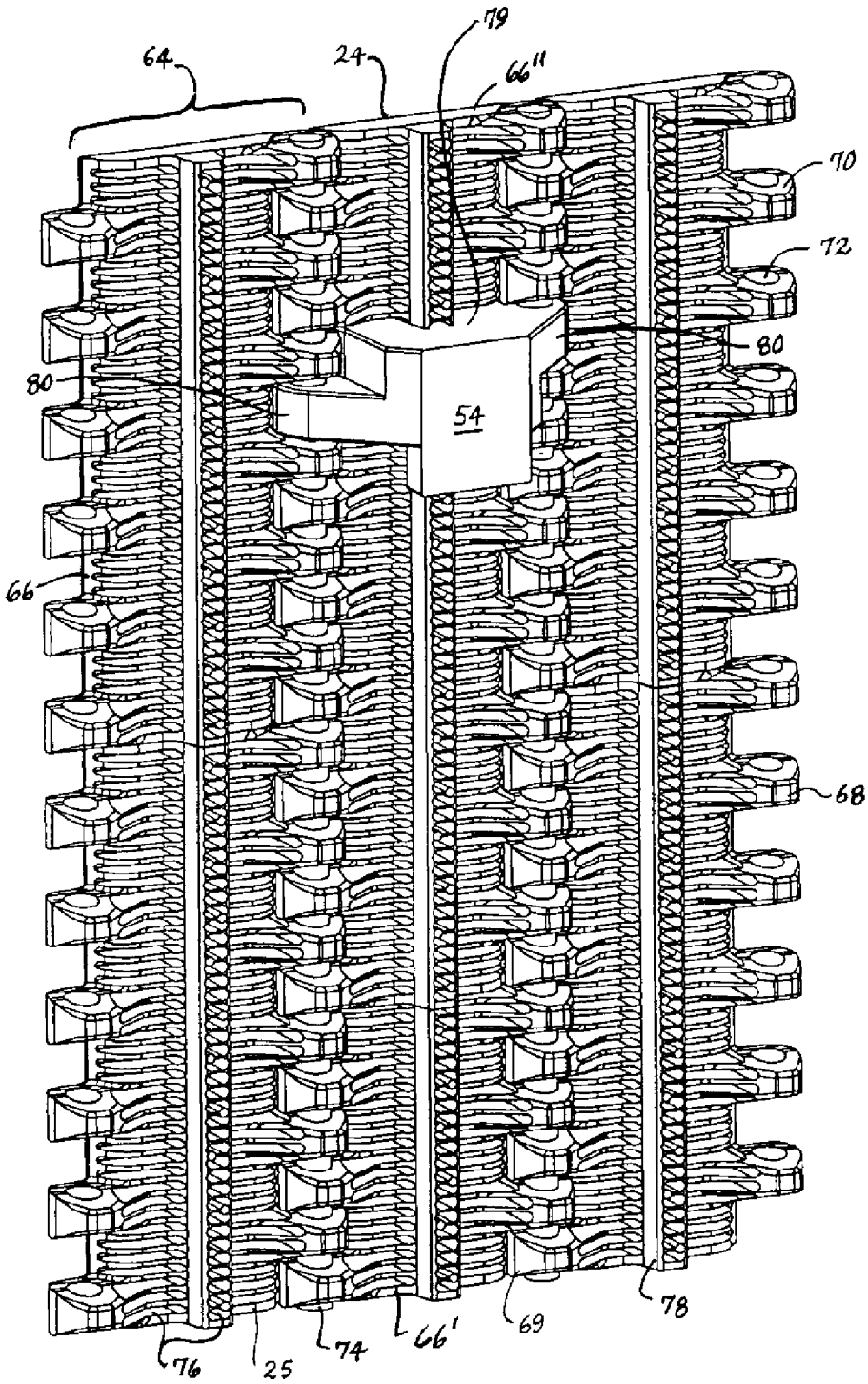
FIG. 8 is an isometric view of a portion of the inner side of a modular belt usable as a water screen as in FIG. 1.

The horizontal traveling screen or curtain may be realized in many ways. For example, it may be constructed of a number of metal or plastic panels held together by hinge rods between roller chains at opposite edges of the screen. As another example, the screen may be realized as a metal mesh chain. Preferably, however, the screen is constructed of a series of rows of modular plastic belt modules as in FIG. 8 arranged in a bricklay pattern. Each row consists of one or more belt modules 66, 66', 66" that extend in length from a first end 68 to a second end 69. Hinge eyes 70 at each end interleave with the hinge eyes of an adjacent row. Aligned apertures 72 through the interleaved hinge eyes form a passageway across the width of the belt. Hinge rods 74 received in the passageways link the rows together at hinge joints, which allow the belt to articulate about the sprockets and backbend at the shoes. The belt is a foraminous belt with openings 76 extending through the thickness of the modules from the outer surface 24 to the inner surface 25. The inner surface includes drive structure 78 for engaging the drive and idle sprockets. One modular plastic belt that is suitable for use as a water screen is the Series 1800 Mesh Top™ belt manufactured and sold by Intralox, L. L. C. of Harahan, La., U.S.A. The hold down tabs 54, which are shown formed on individual small modules 79 having hinge eyes 80 at each end to interfit into the modular belt retained in a belt row by the hinge rods, extend outward of the inner surface of some of the belt modules. The hold down tab may alternatively be integrally molded in a standard module, snapped into a module, bolted into a module, or otherwise attached to the belt. Hold down tabs may be positioned on each row or on some other spacing, such on as every other belt row.

Thus, the invention provides a horizontal traveling water screen especially useful for filtering wide flows.

Although the invention has been described in detail with respect to a preferred version, other versions are possible. For example, there are means to prevent the screen from sagging other than or in addition to the use of hold down tabs and associated tab guides. Stiffer hinge rods made of stainless steel, for instance, can be used to join screen modules. Or stiffer modules with greater beam strength can be used to reduce sag between the sprockets. As another example, the preferred version uses two idle shafts, but it would be possible to use a single idle shaft or more than two idle shafts. The screen is shown driven by sprockets, but could be driven by drums or pulleys or any means capable of advancing the belt across the flow. The details of the take-up mechanism described represent one example of such a mechanism. So, as the few examples suggest, the scope of the claims is not meant to be limited to the preferred versions described in detail.

What is claimed is:

1. A traveling water screen comprising:

a foraminous belt comprising a series of linked together rows of modular plastic belt modules arranged in a bricklay pattern forming an endless loop disposed in a flowing stream of water generally broadside to the flow;

wherein the foraminous belt advances across the stream of water in a generally horizontal direction.

2. A traveling water screen as in claim 1 further comprising a frame including a guide forming a generally horizontal guide surface and wherein the foraminous belt defines an inner loop surface having generally horizontally spaced apart hold down tabs extending from the inner loop surface into supported contact with the guide.

3. A traveling water screen as in claim 1 further comprising:

a drive shaft having a vertical first axis of rotation;

drive wheels mounted on the drive shaft for rotation on the first axis of rotation;

an idle shaft having a second axis of rotation parallel to the first axis of rotation;

idle wheels mounted on the drive shaft for rotation on the second axis of rotation;

wherein the foraminous belt is trained about and engaged by the drive and idle wheels; and a motor coupled to the drive shaft to rotate the drive shaft and the drive wheels to advance the foraminous belt across the stream of water.

4. A traveling water screen comprising:

a screen comprising a series of linked together rows of modular plastic belt modules arranged in a bricklay pattern forming an endless belt loop having an outer surface and an inner surface with openings extending through the thickness of the screen between the outer surface and the inner surface;

means for advancing the screen generally horizontally across a flowing stream of water;

wherein the outer surface of the endless belt loop is oriented transverse to the flow.

5. A traveling water screen as in claim 4 wherein the means for advancing the screen comprises:

a drive shaft having a vertical first axis of rotation;

drive wheels mounted on the drive shaft for rotation on the first axis of rotation;

an idle shaft having a second axis of rotation parallel to the first axis of rotation;

idle wheels mounted on the drive shaft for rotation on the second axis of rotation;

wherein the screen is trained about and engaged by the drive and idle wheels; and a motor coupled to the drive shaft to rotate the drive shaft and the drive wheels to advance the screen across the stream of water.

6. A traveling water screen as in claim 4 further comprising a frame including a guide forming a generally horizontal guide surface and wherein the screen has spaced apart hold down tabs extending from the inner surface into supported contact with the guide.

7. A traveling water screen as in claim 4 wherein the screen comprises a foraminous modular plastic belt.

8. A traveling water screen comprising:

a screen comprising a series of linked together rows of modular plastic belt modules arranged in a bricklay pattern extending in width from a first side edge to a second side edge and arranged in an endless belt loop;

means for advancing the screen through a stream of water;

wherein the first side edge of the screen is at a first depth in the stream and the second side edge is elevated above the stream or is at a second depth less than the first depth.

9. A traveling water screen as in claim 8 wherein the means for advancing the screen comprises:

a drive shaft having a vertical first axis of rotation;

drive wheels mounted on the drive shaft for rotation on the first axis of rotation;

an idle shaft having a second axis of rotation parallel to the first axis of rotation;

idle wheels mounted on the drive shaft for rotation on the second axis of rotation;

wherein the screen is trained about and engaged by the drive and idle wheels; and a motor coupled to the drive shaft to rotate the drive shaft and the drive wheels to advance the screen across the stream of water.

10. A traveling water screen as in claim 8 further comprising a frame including a guide forming a generally horizontal guide surface and wherein the screen defines an inner belt loop surface having hold down tabs parallel to the first and second side edges of the screen extending from the inner belt loop surface into supported contact with the guide.

11. A traveling water screen as in claim 8 wherein the screen comprises a foraminous modular plastic belt.

12. A traveling water screen comprising:

a drive wheel below the surface of a body of water;

a motor coupled to the drive wheel to rotate the drive wheel about a generally vertical axis of rotation;

an idle wheel arranged to rotate below the surface of the body of water about a generally vertical axis parallel to the axis of rotation of the drive wheel;

a screen comprising a series of linked together rows of modular plastic belt modules arranged in a bricklay pattern in the form of an endless belt loop trained about the drive wheel and the idle wheel for advancement in a generally horizontal direction.

13. A traveling water screen as in claim 12 further comprising a frame including a guide forming a generally horizontal guide surface and wherein the screen defines an inner belt loop surface having hold down tabs extending from the inner belt loop surface into supported contact with the guide.

14. A traveling water screen as in claim 12 wherein the screen comprises a foraminous modular plastic belt.

15. A traveling water screen comprising:

a frame;

a drive shaft supported in the frame for axial rotation on a generally vertical first axis;

an idle shaft supported in the frame for axial rotation on a generally vertical second axis;

a drive sprocket mounted on the drive shaft for rotation on the first axis;

an idle sprocket mounted on the idle shaft for rotation on the second axis;

a modular belt comprising a series of linked together rows of modular plastic belt modules trained around and engaging the drive and idle sprockets, the modular belt having openings through its thickness and disposed at least partly submerged in a stream of water;

a motor coupled to the drive shaft to rotate the shaft and the drive sprocket to advance the modular belt through the stream of water.

16. A traveling water screen as in claim 15 wherein the frame includes a guide forming a generally horizontal guide surface and wherein the modular belt defines an inner surface having hold down tabs extending outward into supported contact with the horizontal guide surface of the guide.

* * * * *